US006247515B1

(12) United States Patent
Spatafora

(10) Patent No.: US 6,247,515 B1
(45) Date of Patent: Jun. 19, 2001

(54) UNIT FOR SUPPLYING A STRIP TO A USER MACHINE

(75) Inventor: Mario Spatafora, Bologna (IT)

(73) Assignee: G. D Societa' per Azioni, Bologna (IT)

( * ) Notice: Subject to any disclaimer, the term of this patent is extended or adjusted under 35 U.S.C. 154(b) by 0 days.

(21) Appl. No.: 09/262,703

(22) Filed: Mar. 4, 1999

(30) Foreign Application Priority Data

Mar. 5, 1998 (IT) ..... B098A0128

(51) Int. Cl.[7] ..... B65H 21/00

(52) U.S. Cl. ..... 156/504; 156/304.3; 156/502; 242/552; 242/556

(58) Field of Search ..... 156/157, 159, 156/304.1, 304.3, 502, 504, 507; 242/552, 555, 555.3, 555.4, 555.5, 556

(56) References Cited

U.S. PATENT DOCUMENTS

| | | | | |
|---|---|---|---|---|
| 3,880,698 | * | 4/1975 | Kawazura et al. | 156/504 |
| 4,222,533 | * | 9/1980 | Pongracz | 156/502 X |
| 4,234,365 | * | 11/1980 | Shimizu et al. | 156/64 |
| 4,473,430 | * | 9/1984 | Voltmer et al. | 156/504 |
| 4,645,558 | * | 2/1987 | Sato | 156/504 X |
| 5,131,593 | * | 7/1992 | Siegfried et al. | 242/504 |
| 5,190,234 | * | 3/1993 | Ezekiel | 156/504 X |
| 5,443,681 | * | 8/1995 | Stivani et al. | 156/504 |
| 5,699,978 | | 12/1997 | Hanazawa et al. | 242/552 |
| 5,772,150 | * | 6/1998 | Spatafora | 156/504 X |

FOREIGN PATENT DOCUMENTS

| | | |
|---|---|---|
| 3500825 | 9/1985 | (DE) . |
| 0703149 | 3/1996 | (EP) . |
| 2313296 | 12/1976 | (FR) . |
| 2135283 | 8/1984 | (GB) . |

OTHER PUBLICATIONS

English Abstract of DE 3500825 dated Sep. 26, 1985.
English Abstract of FR2313296 dated Dec. 31, 1976.

* cited by examiner

*Primary Examiner*—Mark A. Osele
(74) *Attorney, Agent, or Firm*—Ladas & Parry

(57) ABSTRACT

A unit for supplying a strip to a user machine, the unit being located along a supply path of the strip, having an input for a first strip of a running-out reel and for a second strip of a new reel, and having two splicing rollers located downstream from the input and on opposite sides of the supply path to butt splice the first and second strip; a first roller of the two rollers defines an end portion of a casting path along which to cast the second strip and extending between the input and the first roller, and provides for casting a leading end portion of the second strip towards the output of the unit in time with a trailing end portion of the first strip.

17 Claims, 2 Drawing Sheets

UNIT FOR SUPPLYING A STRIP TO A USER MACHINE

FIELD OF THE INVENTION

The present invention relates to a unit for supplying a strip to a user machine.

In particular, the present invention relates to a supply unit located along a strip supply path to a so-called "form, fill and seal" cellophaning machine, to which the following description refers purely by way of example.

BACKGROUND OF THE INVENTION

Known supply units normally comprise a splicing device whereby a trailing end portion of a first strip unwound off a running-out reel is joined to a leading end portion of a second strip unwound off a new reel.

Known supply units of the above type provide for splicing the strips either at the respective end portions or by overlapping the strips, and may be provided with compensating stores, located along the supply path, to feed the strip to the user machine during the splicing operation, which, depending on the type of splice, is performed by arresting the running-out strip at least at the unit itself.

Supply units normally comprise two splicing rollers located on opposite sides of the running-out strip and having respective variable-radius outer lateral surfaces to permit passage of the first strip when the rollers are arrested in a standby operating position, and to splice the two strips when the rollers are moved into a tangent operating position. One of the two splicing rollers is normally used as a casting roller for the second strip, i.e. the end portion of the second strip is placed on the lateral surface of the roller, and is brought into contact with the first strip more or less rapidly, depending on the presence of said compensating stores.

Though fairly reliable, supply units of the above type have several drawbacks limiting their use in conjunction with current user machines. That is, some supply units provide for splicing the end portions of the two strips, but require a compensating store for ensuring as accurate a splice as possible and so minimizing waste material. On the other hand, besides failing to ensure accurate splicing of the two strips, thus increasing the amount of waste material, supply units with no compensating stores also fail to provide for high-speed splicing, by the high traveling speed of the strips and the high degree of inertia of the reels subjecting the strips to longitudinal stress which more often than not results in tearing if not actual breakage of the strips.

SUMMARY OF THE INVENTION

It is an object of the present invention to provide a unit for supplying a strip to a user machine without the interposition of said compensating stores, and which also provides for accurately splicing the end portions of a strip unwound off a running-out reel and a strip unwound off a new reel.

According to the present invention, there is provided a unit for supplying a strip to a user machine, the unit comprising at least one input for a first strip of a running-out reel and for a second strip of a new reel, and two splicing rollers located downstream from the input along a supply path of the first strip and on opposite sides of the first strip; the two rollers defining an output for the first strip from the unit, and providing for butt splicing the two strips; and the unit being characterized by comprising accumulating means for accumulating said second strip and defining a casting path for the second strip.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
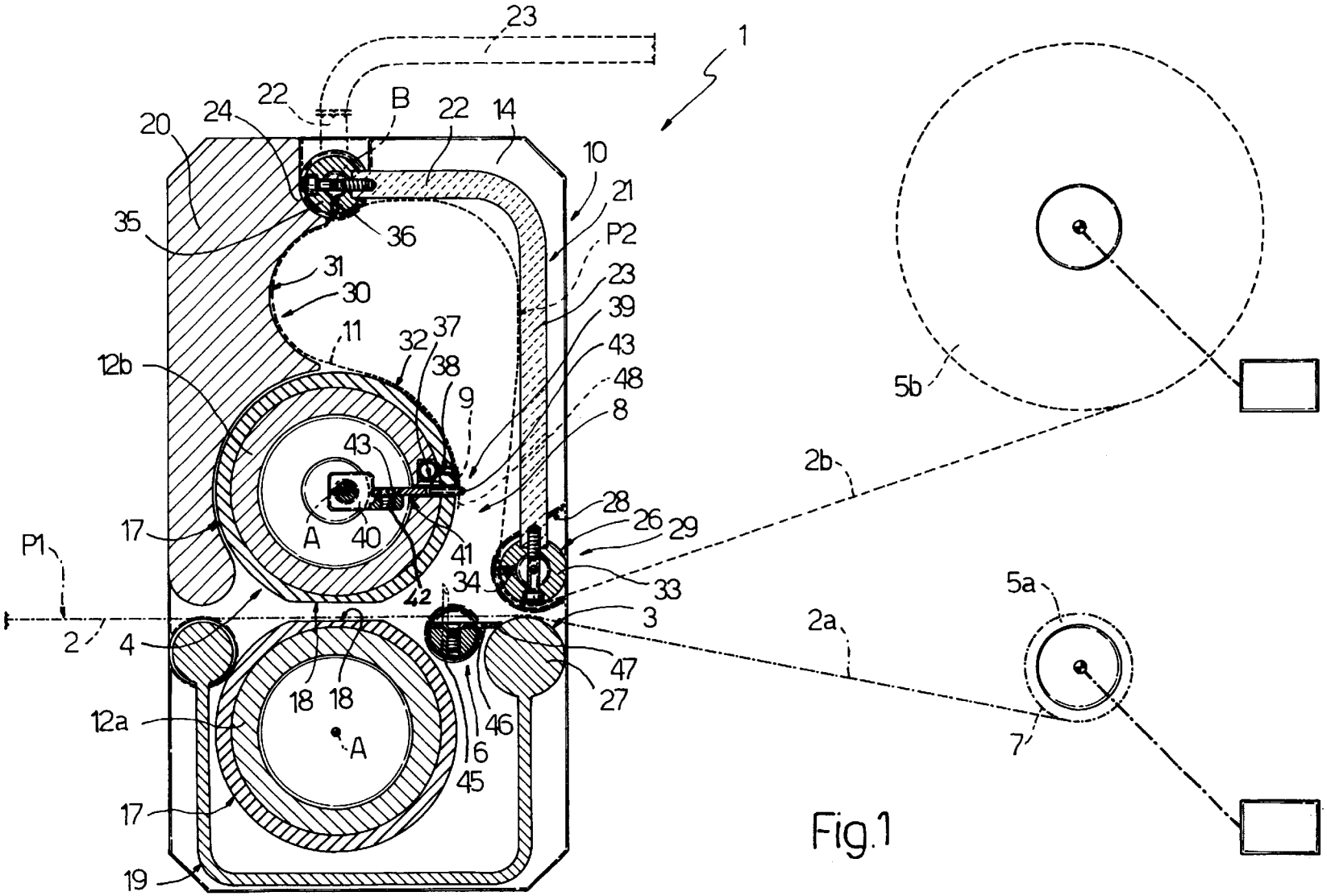
FIG. 1 shows a schematic view, with parts in section and parts removed for clarity, of a supply unit in accordance with the present invention.
Figure 2:
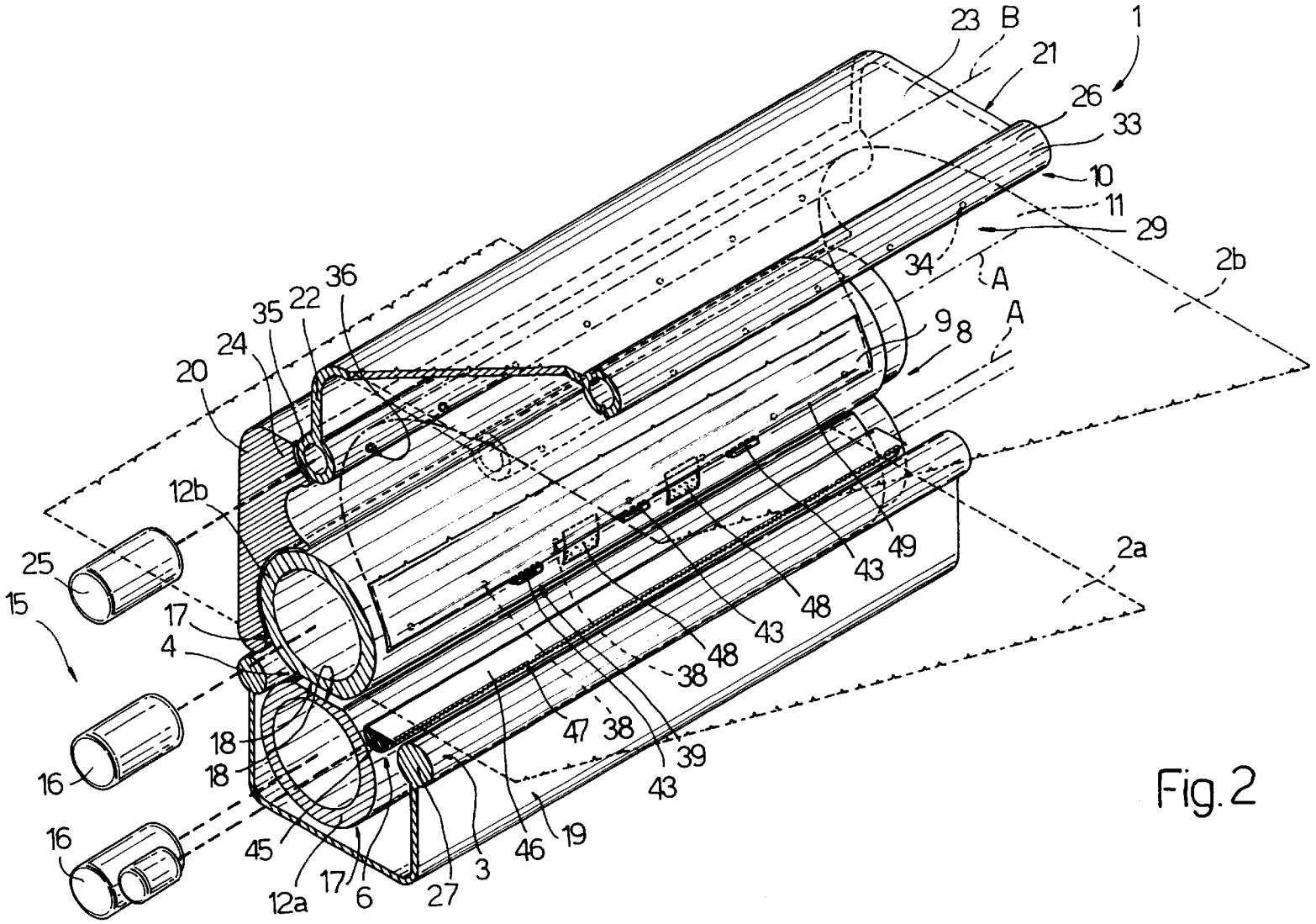
FIG. 2 shows a view in perspective, with parts in section and parts removed for clarity, of the FIG. 1 unit.

Numberal 1 in the accompanying drawings indicates as a whole a unit for supplying a strip 2 to a known user machine not shown.

Unit 1 comprises an input 3 and an output 4 for strip 2, provides for splicing a first strip 2*a* of a running-out reel 5*a* and a second strip 2*b* of a new reel 5*b*, and is located along a supply path P1 extending from reels 5 to said user machine and through input 3 and output 4.

Unit 1 also comprises a cutting device 6 for cutting strip 5*a* (as explained in detail later on) to form on strip 5*a* a trailing end portion 7; a splicing device 8 for splicing portion 7 to a leading end portion 9 of strip 2*b*; and an accumulating device 10 for accumulating strip 2*b* and for setting strip 2*b* to a casting position in which an initial portion 11 of given length of strip 2*b* is kept on standby along a casting path P2 extending inside unit 1 from input 3 and in parallel with path P1.

Splicing device 8 comprises two splicing rollers 12, which are fitted in rotary manner to two vertical lateral walls 14 (only one shown) of unit 1, are located downstream from input 3 along path P1, are positioned symmetrically on opposite sides of strip 2*a* and path P1, and are rotated in opposite directions and in time with each other about respective horizontal axes A of rotation by a drive device 15 comprising, for each roller 12, a respective motor 16 connected in known manner to roller 12. Rollers 12 are defined laterally by respective cylindrical surfaces 17, have respective longitudinal flat portions 18 formed on surfaces 17, and rotate between a fixed standby position, in which the two flat portions 18 are positioned facing and parallel to each other to define output 4, and a movable splicing and casting position, in which the two rollers 12 are positioned substantially contacting each other to splice strips 2.

Accumulating device 10 comprises a rectangular-section cup-shaped body 19 located between walls 14 and beneath rollers 12, and partly surrounding the bottom roller 12 (beneath path P1 and indicated 12*a*); a rear lateral wall 20 extending transversely between walls 14 and over path P1 and output 4; and an L-shaped lid 21 located substantially on the opposite side of rollers 12 to wall 20, and which comprises a top panel 22 and a bottom panel 23 perpendicular to each other and defining a front wall of unit 1 opposite wall 20. Lid 21 is hinged to a top end 24 of wall 20 to rotate—either manually or by means of a motor 25 forming part of device 15, and about an axis B of rotation parallel to axis A—between a raised open position (shown by the dash line in FIG. 1), and a lowered closed position in which a cylindrical edge 26 of panel 23 faces a cylindrical top edge 27 of cup-shaped body 19 to define input 3, and is engaged laterally inside two recesses 28 formed in respective walls 14.

Device 10 also comprises a pneumatic retaining device 29 for retaining portion 11 of strip 2*b* along casting path P2 and inside a bend 30 defined by lid 21, by an inner cylindrical surface 31 of wall 20 at end 24, and by a lateral portion 32 of surface 17 of top roller 12, which is located over path P1, is indicated 12*b*, and is movable adjacent to wall 20 so that, at the point at which surface 31 terminates along path P2, the tangent to surface 31 substantially coincides with the tangent to surface 17 of roller 12*b* at the same point. Panels 22 and 23 of lid 21 and surface 31 define a fixed portion of path P2, while portion 32 defines a movable portion of path P2, which is substantially U-shaped.

Device 29 comprises a suction conduit 33 defined by edge 26 and having a number of radial holes 34; a suction conduit 35 defined by a cylindrical body coaxial with axis B and having a number of radial holes 36; a suction conduit 37 fitted parallel to axis A inside roller 12*b* and communicating with the outside of roller 12*b* through a number of holes 38 aligned parallel to axis A; a known suction pump (not shown) connected to conduits 33, 35, 37; and a stop device 39 integral with roller 12*b* and acting as a fixed stop for leading end portion 9 of strip 2*b*. Device 39 comprises a supporting bracket 40 fitted inside roller 12*b*, eccentrically with respect to respective axis A, and rotating about axis A with roller 12*b*; a comb 41 having a rib 42 connected to bracket 40; and three teeth 43 movable through respective holes 44 formed through surface 17 of roller 12*b*. The three holes 44 are aligned parallel to axis A of roller 12*b*, are located immediately downstream from holes 38 in the rotation direction (clockwise in FIG. 1) of roller 12*b*, and are located substantially 90° upstream from respective flat portion 18.

Cutting device 6 comprises a supporting bar 45 fitted in rotary manner to walls 14; and a blade 46 fitted to bar 45 and movable between a rest position, in which the cutting edge 47 substantially contacts edge 27 to clear strip 2*a*, and a cutting position in which edge 47 is raised off edge 27 and crosses path P1 to intercept strip 2*a*.

Operation of unit 1 will now be described as of the instant in which the two rollers 12 are set to the fixed standby position, blade 46 is set to the rest position, lid 21 is set to the lowered closed position, and a strip 2*a* is unwound off a reel 5*a* and fed at a substantially constant speed V1 along path P1. Strip 2*a*travels through input 3 and output 4 and between flat portions 18 of rollers 12, and is unwound off reel 5*a*both by the pull exerted on strip 2*a* by the user machine, and by the powered supporting pin of reel 5*a*, which, on account of its size, has a high degree of inertia.

As strip 2*a* is unwound off reel 5*a*, the unit 1 operator rotates lid 21 about axis B into the open position to open unit 1, and unwinds off reel 5*b* a long enough portion of strip 2*b* to arrange strip 2*b* about bend 30. More specifically, the operator fixes two pieces of adhesive tape 48 to leading end portion 9 of strip 2*b*, and places portion 9 on lateral portion 32 of roller 12*b* so as to cover lateral portion 32 of roller 12*b* with strip 2*b* and rest the end edge 49 of strip 2*b*on the three teeth 43. When placed over holes 38 on surface 17, portion 9 is retained on roller 12*b* by the suction through holes 38; at which point, portion 11 is arranged by the operator along path P2 and on conduits 33 and 35, and is retained in the casting position by the suction through holes 34 and 36.

At this point, the operator closes lid 21 either manually or using motor 25; and the length of strip 2*b*accumulated along path P2 inside unit 1 is sufficient to cast leading end portion 9 with no damage whatsoever to strip 2*b*.

As blade 46 is moved into the cutting position to cut strip 2*a* and form trailing end portion 7 of strip 2*a*, the suction along conduits 33 and 35 is cut off, and the two rollers 12 are activated and accelerated to bring portion 9 not only into contact with portion 7 at output 4, but also up to the same speed V1 as strip 2*a*by rotating roller 12*b* by an angle of substantially 90°.

As rollers 12 are accelerated, reel 5*b* is also rotated about the respective axis by a respective motor, but, as the inertia of reel 5*b* makes it difficult to impart to strip 2*b* the same acceleration as portion 9, the length of strip 2*b* along path P2 is used up at least during the 90° rotation of roller 12*b*. As the two rollers 12 move into the movable splicing position, portions 7 and 9 are pressed against each other by the two surfaces 17, and the gummed surfaces of adhesive tape 48 are pressed onto portion 7. At the same time, the suction through holes 38 is cut off and, by virtue of the eccentricity of bracket 40, teeth 43 are withdrawn completely inside respective holes 44.

The rotation of rollers 12 and the different unwinding speed of reel 5*b* result in portion 11 being used up gradually and detached from surface 31 and the inner surfaces of panels 22 and 23. Before portion 11 is used up entirely, however, blade 46 is reset to the rest position clear of path P1; and, once the two strips 2 have been spliced, the two rollers 12 are reset to the fixed standby position to allow strip 2 to be fed along path P1.

By the time roller 12*b* rotates over 90° but less than 360°, reel 5*b* rotates steadily so that, once rollers 12 are reset to the fixed standby position, the new strip 2*b* is fed safely at speed V1.

Path P2 therefore provides for accumulating a given length of strip 2*b*, for splicing strips 2 without arresting strip 2*a*, and also for accurately splicing end portions 7 and 9 with no risk of tearing strip 2*b*.

What is claimed is:

1. A unit for supplying a strip to a user machine, the unit (1) comprising at least one input (3) for a first strip (2*a*) of a running-out reel (5*a*) and for a second strip (2*b*) of a new reel (5*b*), two splicing rollers (12) located downstream from the input (3) along a supply path (P1) of the first strip (2*a*) and on opposite sides of the first strip (2*a*); the two rollers (12) defining an output (4) for the first strip (2*a*) from the unit, and providing for butt splicing the two strips (2); and accumulating means (10) for accumulating said second strip (2*b*) and defining a casting path (P2) for the second strip (2*b*), said accumulating means (10) comprising a fixed portion (31) defined by a lateral wall (20) of said unit (1) and a movable portion defined by a lateral portion (32) of a first roller (12*b*) of said two rollers (12); and a lid (21) having a lateral frame (26) defining said input (3).

2. A unit as claimed in claim 1, wherein said casting path (P2) is locate in parallel with the supply path (Pl) between said input (3) and said output (4).

3. A unit as claimed in claim 1, wherein said casting path (P2) comprises a fixed portion extending from said input (3); and a movable portion located in series with the fixed portion and substantially defined by said output (4).

4. A unit as claimed in claim 3, wherein the movable portion of said casting path (P2) is defined by a lateral portion (32) of a first roller (12*b*) of said two rollers (12).

5. A unit as claimed in claim 1, wherein said casting path (P2) defines, inside the unit (1), a bend (30) for accumulating said second strip (2*b*).

6. A unit as claimed in claim 5, wherein said casting path (P2) is substantially U-shaped.

7. A unit as claimed in claim 1, wherein said accumulating means (10) comprises retaining means (29) for retaining said second strip (2*b*) in a casting position along said casting path (P2).

8. A unit as claimed in claim 7, wherein said retaining means (29) comprises pneumatic means.

9. A unit as claimed in claim 7, wherein said lid (21) can be set selectively to a raised loading position, and to a lowered work position in which the lid defines a fixed portion of said casting path (P2).

10. A unit as claimed in claim 9, wherein said retaining means (29) comprises a fixed part (33, 35) associated with said lid (21).

11. A unit as claimed in claim 1, further comprising casting means (12*b*, 39) associated with said rollers (12) to cast a leading end portion (9) of said second strip (2*b*) towards said output (4) in time with a trailing end portion (7) of said first strip (2*a*).

12. A unit as claimed in claim 11, further comprising cutting means (6) for cutting said first strip (2*a*) to define said trailing end portion (7) of the first strip (2*a*).

13. A unit as claimed in claim 12, wherein said retaining means (29) is carried by a first roller (12*b*) of said two rollers (12) to retain the leading end portion (9) of said second strip (2*b*) on the first roller (12*b*) at least up to said output (4).

14. A unit as claimed in claim 11, wherein said accumulating means (10) further comprises retaining means (29) for retaining the leading end portion (9) of said second strip (2*b*) in a casting position along said casting path (P2).

15. A unit for supplying a strip to a user machine, the unit (1) comprising at least one input (3) for a first strip (2*a*) of a running-out reel (5*a*) and for a second strip (2*b*) of a new reel (5*b*), and two splicing rollers (12) located downstream from the input (3) along a supply path (P1) of the first strip (2*a*) and on opposite sides of the first strip (2*a*); the two rollers (12) defining an output (4) for the first strip (2*a*) from the unit, and providing for butt splicing the two strips (2); accumulating means (1) for accumulating said second strip (2*b*) and defining a casting path (P2) for the second strip (2*b*); said accumulating means (10) comprising a fixed portion (31) defined by a lateral wall (20) of said unit (1); and a movable portion defined by a lateral portion (32) of a first roller (12*b*) of said two rollers (12); said first roller (12*b*) comprising stop means (39) for a leading end portion (9) of said second strip (2*b*); said stop means (39) being movable with respect to said movable portion, to and from an extracted stop position in which the stop means is located outside the lateral portion (32) of said first roller (12*b*).

16. A unit for supplying a strip in a user machine, the unit (1) comprising at least one input (3) for first strip (2*a*) of a running-out reel (5*a*) and for a second strip (2*b*) of a new reel (5*b*), and two splicing rollers (12) located downstream from the input (3) along a supply path (P1) of the first strip (2*a*) and on opposite sides of the first strip (2*a*); the two rollers (12) defining an output (1) for the first strip (2*a*) from the unit, and providing for butt splicing the two strips (2); accumulating means (10) for accumulating said second strip (2*b*) and defining a casting path (P2) for the second strip (2*b*); said accumulating means (10) comprising a fixed portion (31) defined by a lateral wall (20) of said unit (1); and a movable portion defined by a lateral portion (32) of a first roller (12*b*) of said two rollers (12); said first roller (12*b*) comprising stop means (39) for a leading end portion (9) of said second strip (2*b*); said accumulating means further comprising retaining means (29) for retaining said second strip (2*b*) in a casting portion along said casting path (P2); said retaining means (29) comprising a movable part (37) associated with said first roller (12).

17. A unit as claimed in claim 16, wherein said movable part (37) is fitted to said first roller (12*b*).

* * * * *